United States Patent [19]

Veltman

[11] 4,294,624

[45] Oct. 13, 1981

[54] DRYING CO-MINGLED CARBOHYDRATE SOLUTION AND RECYCLED PRODUCT BY DIELECTRIC HEATING

[76] Inventor: Preston L. Veltman, 212 Old County Rd., Severna Park, Md. 21146

[21] Appl. No.: 130,531

[22] Filed: Mar. 14, 1980

[51] Int. Cl.[3] ..... C13F 1/00; C13F 5/00; C13K 11/00

[52] U.S. Cl. ..... 127/62; 127/30; 159/DIG. 1; 159/DIG. 26; 219/10.55 A; 219/10.55 M; 219/10.65

[58] Field of Search ..... 127/30, 61, 62; 159/DIG. 1, DIG. 26; 219/10.55 A, 10.55 M, 10.65

[56] References Cited

U.S. PATENT DOCUMENTS

| | | | |
|---|---|---|---|
| 3,072,490 | 1/1963 | Sargeant | 219/10.65 |
| 3,528,179 | 9/1970 | Smith | 219/10.55 A |
| 3,549,848 | 12/1970 | Williams | 219/10.55 A |
| 3,582,399 | 6/1971 | Black | 127/61 X |
| 3,600,222 | 8/1971 | Veltman | 127/30 |
| 3,619,293 | 11/1971 | Niimi | 127/61 X |
| 3,655,442 | 4/1972 | Schwer | 127/62 X |
| 3,668,358 | 6/1972 | Stenstrom | 219/10.55 A |
| 3,674,557 | 7/1972 | Gray, Jr. | 127/62 |
| 3,712,971 | 1/1973 | Admiraal | 219/10.55 A |
| 3,956,009 | 5/1976 | Lundquist | 127/61 X |
| 4,045,639 | 8/1977 | Meisel | 219/10.55 A |
| 4,162,926 | 7/1979 | Veltman | 127/62 |
| 4,162,927 | 7/1979 | Morfin-Alvarez | 127/61 X |

*Primary Examiner*—Sidney Marantz
*Attorney, Agent, or Firm*—Armstrong, Nikaido, Marmelstein & Kubovcik

[57] ABSTRACT

A method of forming dried, solid particulate products from carbohydrate solutions, including complex carbohydrate solutions in the presence of recycled dried product using dielectric heating to supply heat of water vaporization.

13 Claims, 10 Drawing Figures

FIG. 1
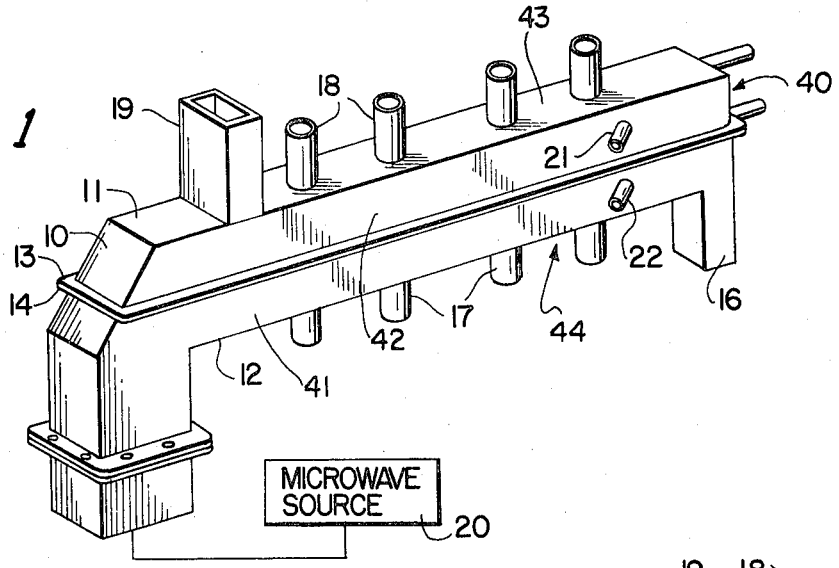
FIG. 2
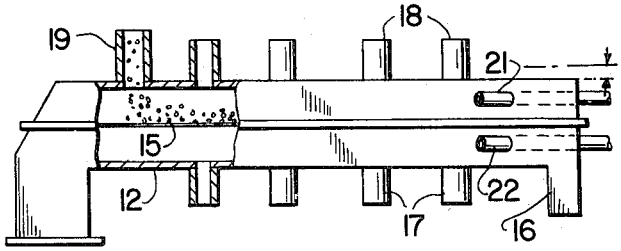
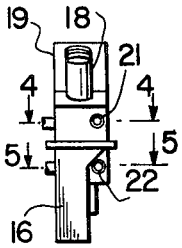
FIG. 3
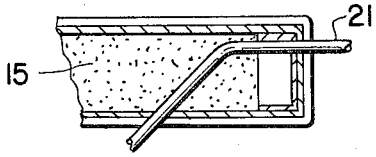
FIG. 4
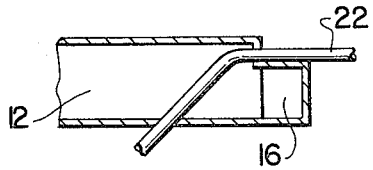
FIG. 5

DRYING CO-MINGLED CARBOHYDRATE SOLUTION AND RECYCLED PRODUCT BY DIELECTRIC HEATING

BACKGROUND OF THE INVENTION

1. Field of the Invention

This invention relates to a method of drying which is especially effective for forming solid, particulate and stable products from carbohydrate solutions, including complex carbohydrate solutions.

2. Description of the Prior Art

U.S. Pat. Nos. 3,600,222, 3,956,009 and 4,162,926 teach methods for forming particulate, free-flowing solid products from sugar solutions.

U.S. Pat. No. 3,600,222 discloses a process for drying sucrose solutions wherein separate feeds of sucrose solution and fine sucrose particles are dispersed in a current of heated air, water is evaporated from the sucrose solution which becomes coated on the sucrose particles, and the coated particles are recovered.

U.S. Pat. No. 3,956,009 teaches a process for preparing dried free-flowing particulate solid particles from fructose solutions wherein a dispersed fructose solution is dried in a current of heated gas in the presence of separately introduced recycled dried solid product.

U.S. Pat. No. 4,162,926 is directed to a process for the production of a dried, free-flowing stable particular sugar product from difficultly crystallizable complex sugar solutions by a process wherein dispersed complex sugar solutions are spray-dried in a current of heated gas in the presence of separately introduced recycled solid product which has been subjected to a conditioning step wherein the moisture content of the spray-dried product is reduced to an amount not greater than 0.5% by contacting spray-dried product with a conditioning gas having a humidity of less than 50% and a temperature below the melting point of the solid.

While the prior art has provided means for drying sugar solutions, including complex sugar solutions, improvements are desirable, especially in the specific means used to obtain the low water content necessary for product particles having free-flowing stability. Previously known processes depend upon convectively and conductively supplied energy to provide heat of water evaporation. The allowable temperature differences between the heat supplying source and the solid surface at which evaporation occurs are economically and process operationally important. These facts impose severe and costly equipment design requirements for commercial operation of previously knowm methods of producing dried, solid, particulate sugar products from complex sugar solutions.

SUMMARY OF THE INVENTION

The principal objects of the present invention are (a) to produce (from carbohydrate solutions) dried, solid particulate carbohydrate products which remain in a dry, solid particulate state for an extended period of time; and (b) to provide a method or process for preparing such products from carbohydrate solutions.

The present invention involves the production of dried, free-flowing, stable particulate products from difficultly crystallizable carbohydrate solutions by a process which comprises drying the solution in the presence of recycled dry solid product using dielectric heating to supply heat of water evaporation.

BRIEF DESCRIPTION OF THE DRAWINGS

FIGS. 1–7 show a preferred microwave (electromagnetically or dielectrically) heated fluidized bed apparatus for use in conducting the drying step of the process of this invention, to wit:

FIG. 1 is a perspective view of one embodiment of the apparatus;

FIG. 2 is a plan view of the embodiment of FIG. 1;

FIG. 3 is a side view in elevation of the embodiment of FIG. 1;

FIG. 4 is a partial section plan view taken along line 4—4;

FIG. 5 is a partial section plan view taken along line 5—5;

FIG. 6 is a front view in elevation of another embodiment of the apparatus and partially cut-away; and FIG. 7 is a plan view of the embodiment shown in FIG. 6.

DETAILED DESCRIPTION OF THE INVENTION

Figure 6:
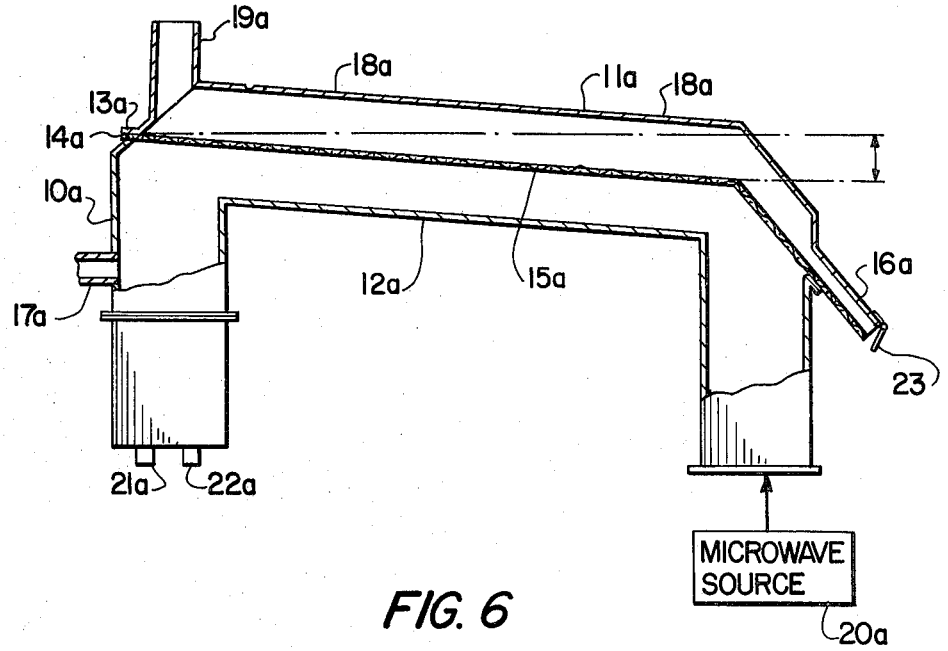

The present invention is directed to an improved process for the production of dried particulate carbohydrate products from: (a) solutions of difficultly crystallizable pure carbohydrates; and (b) complex carbohydrate solutions (i.e., solutions containing mixtures of carbohydrates). Such solutions as, for example, Isomerose 900 brand fructose corn syrup have been found to be difficultly economically crystallizable.

This invention is also directed to a process for drying (a) a syrup or solution of a pure carbohydrate (e.g., a sugar) or (b) a complex carbohydrate solution or syrup to form a dry, free-flowing, particulate solid comprising the pure carbohydrate or the complex carbohydrate, respectively. The carbohydrate component (or components) of such syrup can be a sugar or a mixture of sugars. Said syrup is also known as sugar syrup, carbohydrate syrup, sugar solution or simply as syrup solution, or as complex carbohydrate solution. In said process, the carbohydrate solution is mingled with finely divided recycled product (which is also known as recycled solid product, recycled product, recycled solids, recycle solids, recycle product, recycled material or simply as recycle) to effectively distribute the carbohydrate syrup over the surface of the recycled product particles to obtain a particulate material amenable to conveying thorugh a dielectric (electromagnetic) heating operation.

Electromagnetic energy in the radio-frequency range is particularly effective for evaporating water. Water has a far greater dissipation factor than the associated sugars. The relative response to dielectric heating of water is 0.4, whereas carbohydrates have a response of 0.1 or less. Further, as water is vaporized from a given volume of material, the rate of electromagnetic energy absorption drops abruptly as the water is vaporized, minimizing local overheating. Evaporated water is conveyed out of the dielectric heating zone via (a) a gas stream or (b) a vacuum—with or without a stream of sweep gas. Material temperature within the dielectric heating unit is a function of the summation of the electromagnetic energy used to vaporize water and that absorbed by solids present, balanced by the heat removed from the system by a through-flowing gas stream, or by water vapor per se when using vacuum without a sweep gas. The gas stream, which is preferably cooled before entering the dielectrically heated dryer, not only serves to remove water vapor from the system, but also serves as a means to control the temperature of the particulate material within the dielectrically heated dryer. The temperature of the particulate material in the dryer must be maintained below the fusion point of such material. Preferably, the water content of the gas stream should be maintained below the saturation point. The dried product from the dielectric heating unit has a water content of near zero.

The dried product (granules), when examined with the unaided eye, appear to be clusters of microcrystals, thereby giving the dried product an amorphous character. When the dried particles are crushed between one's teeth, they have a grainy texture indicating a microcrystalline structure (i.e., the presence of micro-crystals) rather than a taffy-like structure. The dryer output is split, part to product and part to recycle. The product is sized as desired, but the recycle must be reduced in particle size so as to obtain a recycle material having extensive surface on which to disperse the sugar solution being dried.

Recycle particle size and quantity of recycled solid product used relative to the quantity of sugar (or carbohydrate) solution dried per unit of time can be varied within mechanically operable limits.

I have found that recycled solids having a particle size of from 50 to 500 microns provide adequate surface on which to distribute fresh feed (carbohydrate or sugar solution) using a wide range of other operating conditions, although this particular particle size is not a limitation in the instant process. Small recycle particles have more surface per unit weight on which a given amount of solution can be distributed than have larger particles. Selection of a given recycle particle size range, in a commercial process, is made on the basis of cost of grinding to obtain sufficient surface to operate with a desired recycle solids-to-fresh feed ratio.

Co-mingling recycled particulate solids (preferably having a particle size of about 50–500 microns) with a carbohydrate solution forms loosely bonded agglomerated particles having a somewhat loose granular structure with the carbohydrate solution on the surfaces of the individual recycled particulate solids comprising the agglomerated particles (granules) which are fed to a dielectrically heated dryer in the process of this invention. A relationship which controls granular size (i.e., the size of the granules fed into the dielectrically heated drying zone) for efficient operation of the drying step in the process of this invention has been observed to exist between granule size and moisture (water) content of said granules.

That is to say, the process is operable with granules containing about 1% or less moisture having a particle size ("major dimension", (i.e., a maximum or major cross-section or "diameter")) not exceeding 7 to 8 mm while similar granules having a moisture content of about 4% or slightly greater (e.g., about 4.05 or 4.1%) must have a major dimension of only 3 to 4 mm for efficient operation of the drying step. Although smaller granules are operable, little or nothing is gained by using smaller granules.

Granules having intermediate amounts of water (i.e., more than 1% and less than 4%) should be intermediate in size (i.e., have a major dimension greater than about 4 mm but less than about 7 mm).

Determining the largest operable major dimension for individual granules containing such intermediate amounts of water is, because of this disclosure, a simple matter for those skilled in the art. This can be done by preparing a lot (e.g., 100 g) of granules having a predetermined intermediate water content and a predetermined particle size greater than 3 mm and less than 7 mm by co-mingling an appropriate amount of an appropriate carbohydrate solution and an appropriate amount of recycled product (ca. 50–500 microns in size) or an appropriate simulated recycled material. The resulting loosely bound granules are crushed as necessary and classified (e.g., with screens or sieves of appropriate size) to obtain particles having said predetermined size. The resulting sized granules are then dried in a dielectrically heated oven as described in Example 1, infra.

If the granules dry to form a free-flowing substantially water-free granule product, they are of an operable size. The operator may decide to use granules of such size or he may decide to test somewhat larger granules in the hope that they are operable. On the other hand, if the granules do not become dry when in the heated oven for about 3 minutes or if they melt or tend to "pseudo-melt" (i.e., soften) and form globules rather than lose their water in the drying step, they are too large for efficient operation of the process.

In commercial operation, crushing and classifying steps (not shown in the drawings) with appropriate recycle of oversized particles from the classifying step to the crushing step, can be placed between the co-mingler (see FIGS. 8, 9 and 10) and the dielectrically heated dryer (see FIGS. 8, 9 and 10) to adjust the size of granules passing from the co-mingler to said dryer.

This process should not be used with granular dryer feed which contains more than about 4% water (e.g., more than about 4.05 or 4.1% water) because efficient drying will not result.

Apparatus required includes: (a) means to co-mingle the carbohydrate solutions with the recycled solid product; (b) a dielectrically heated dryer; (c) means to remove water vapor from the dryer using a gas stream of controlled flow rate and temperature or vacuum with or without a sweep gas; (d) means to separate the dryer output into product and recycle solids; and (e) means to control the particle size of recycled product.

FIGS. 1–7 show a drying apparatus, a microwave (i.e., a dielectrically heated) fluidized bed dryer which is described in U.S. Pat. No. 3,528,179, J. F. Smith, inventor, for Microwave Fluidized Bed Dryer, issued Sept. 15, 1970. This patent, in its entirety, is incorporated herein by reference. Said dryer is excellently adapted for use as a dryer in the process of this invention. However, other dielectrically heated dryers can be used with excellent results in said process.

Referring particularly to FIGS. 1–5 of the drawings, 10 is a transmission waveguide composed of an upper portion 11 and a lower portion 12. Upper portion 11 has a flange 13 about its lower circumference, and lower portion 12 has a flange 14 about its upper circumference, the lower portion and upper portion being joined at flanges 13 and 14. Upper portion 11 and lower portion 12 may be joined in a manner which will allow easy opening or separation of the portions to provide ready access to the interior of waveguide 10. Membrane 15 is captured between flanges 13 and 14 and transversely separates upper portion 11 and lower portion 12. Membrane 15 may be of a variety of materials which are porous or permeable and will readily pass air or other suitable gas, but are impervious to the material to be dried. The membrane should also have a low dielectric loss factor for microwave energy, and preferably is electrically transparent. A variety of materials are available for this application, including various nylon fabrics, porous ceramics and glass wool, but the invention is in no way limited to any particular fabric or material.

Membrane 15 stretches completely across the width and length of waveguide 10, dividing the waveguide into an upper portion and a lower portion. However, in the particular embodiment illustrated in FIG. 1, the membrane is apertured at discharge end 40 of waveguide 10 in the area above material output duct 16, as shown in detail in FIGS. 4 and 5. In this embodiment, the treated material is allowed to pass from upper portion 11 through lower portion 12 and be discharged through output duct 16 by means of the aperture provided.

It will be noted that the height of vertical walls 41 and 42 of waveguide 10 is greater than the width of the top 43 and bottom 44 walls of waveguide 10. That is, the side or vertical walls are the broad walls of the waveguide, whereas the top and bottom walls are the narrow walls of the waveguide.

A material inlet duct 19 is provided in top wall 43 of waveguide 10, the duct being oriented across the width of the top wall of the waveguide. Material output duct 16 is provided at the opposite end of waveguide 10 oriented across the bottom wall of the waveguide.

Gas inlet ports 17 are spaced lengthwise of the bottom wall of waveguide 10, and gas outlet or exhaust ports 18 are spaced lengthwise of the top wall of waveguide 10. It will be understood that the apparatus is not limited to any specific number of gas inlet or outlet ports and that the plurality shown in the drawing is intended to be illustrative only. There may be only one gas inlet port and one outlet port, or there may be a plurality of either or both. Moreover, the gas inlet ports may be each connected to an independent source of gas, or they may be interconnected by a manifold means (not shown) and supplied with gas from a single source. Similarly, when a plurality of outlet ports is employed, the outlet ports may be interconnected by a manifold means (not shown). If desired, inlet ports 17 and outlet ports 18 may be interconnected through means (not shown) to provide for a continuous recirculation of the treating gas. Preferably, air is used as the treating gas, but the apparatus is not limited thereby and other gases can be used as desired for particular materials and conditions.

Source 20 of microwave energy may be located at the material inlet end of waveguide 10, which source may be selected from a variety of available microwave generators, such as the microton, magnetron, klystron and the like. In the preferred embodiment shown in the drawings, waveguide 10 is curved 90° at the input end. In this manner, the installation of microwave source 20 does not interfere with the continuity of membrane 15. It is understood that this particular configuration is preferred, and that other configurations can be arranged for terminating membrane 15 when the microwave energy source is located at the inlet end of waveguide 10.

Load tubes 21 and 22 may be arranged near the discharge end of waveguide 10, passing through the upper and lower portions thereof. In this embodiment, output duct 16 is dimensioned to allow load tube 22 to pass through the end wall of waveguide 10 without interference with the outflow of treated material, as shown in FIGS. 3, 4 and 5. Load tubes 21 and 22 may be coupled to a source of water or other lossy liquid not shown, and a provision made for the continuous circulation of the liquid through load tubes 21 and 22.

It has been observed that when microwave energy is transmitted through waveguides of various geometric shapes and dimensions, varying electric and magnetic fields may be set up in the waveguides. In the apparatus of FIGS. 1 through 5, it is preferred that waveguide 10 be of rectangular cross-section dimensioned so as to propagate only the $TE_{10}$ mode. This mode has a maximum electric field at the center of a broad wall of the waveguide and normal to the broad wall. It has also been observed that maximum coupling of microwave energy to a thin or granular product occurs when the product is located within the maximum electric field oriented parallel to the product. In the apparatus of the present invention, this is accomplished through the provision of membrane 15 transverse of the broad walls of waveguide 10.

Still another characteristic of a rectangular waveguide propagating the $TE_{10}$ mode is that a longitudinal slot may be present at the mid-point of the broad walls without significant leakage of microwave energy. In the apparatus of the present invention, upper portion 11 is joined to lower portion 12 to form waveguide 10 having the broad walls oriented vertically. Upper portion 11 is separated from lower portion 12 by membrane 15, which creates a slot, electrically speaking, due to the dielectric characteristics of the membrane. However, since the slot occurs in the broad walls of waveguide 10, the loss of microwave energy caused thereby is insignificant.

It has also been found that microwave energy will not propagate through a duct having sufficiently small dimensions relative to the wavelength of the microwave energy. In the present apparatus, material inlet duct 19, output duct 16 and gas ports 17 and 18 are preferably dimensioned so as to function as waveguides beyond cutoff, thereby preventing the escape of microwave energy from waveguide 10 through ducts 16 and 19, and ports 17 and 18.

Preferably, the dimension of ducts 16 and 19 and ports 17 and 18 measured along the longitudinal axis of waveguide 10 is less than $\frac{1}{2}$ the wavelength of the microwave energy propagated through waveguide 10, in the embodiment illustrated in FIGS. 1–5.

When microwave energy is introduced into a waveguide or chamber, it is preferred that as much of the energy as possible is absorbed, in order to prevent the energy from being reflected back to the microwave generator which may cause serious damage to the generator. When microwave energy is used in heating and drying substances, it is preferred that the total energy output of the microwave generator be absorbed by the material to be treated in order to operate at maximum efficiency. However, this ideal absorption may not be attained and any excess microwave energy will vary with the material treated, the volume of material, the throughput speed and so forth. In order to provide for these variances, load tubes 21 and 22 are provided near the output end of waveguide 10. A lossy liquid, such as water, is circulated through the load tubes to absorb any excess microwave energy not absorbed by the material treated.

Figure 7:
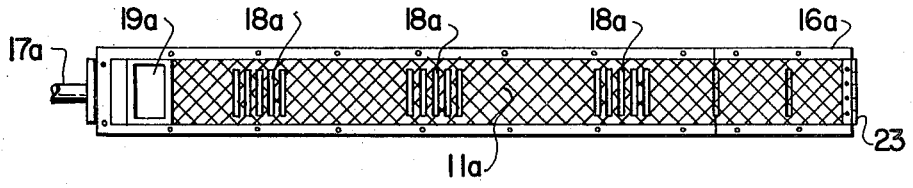

FIGS. 6 and 7 show another embodiment of the apparatus of said U.S. Pat. No. 3,528,179 which is excellently adapted for use as a dielectrically heated fluid bed dryer in the process of this invention. In this embodiment, upper portion 11*a* of waveguide 10*a* may be of a perforated material lined with a transparent polyethylene-type film material with a low loss factor such as Du Pont's Mylar brand. In this configuration, the product to be treated is viewable through upper portion 11*a* as it passes through waveguide 10*a*.

In this embodiment, microwave energy may be introduced into the waveguide at the product output end of the waveguide from microwave energy source 20*a*. Load tubes 21*a* and 22*a* are provided at the product input end of the waveguide to absorb any microwave energy not dissipated in the product being treated.

Treating gas is introduced into waveguide 10*a* through port 17*a*. The gas may be exhausted from the waveguide through one or more slots 18*a* in the liner of upper portion 11*a* allowing gas flow through the perforations in the waveguide upper portion 11*a*.

In this embodiment, waveguide 10*a* is angled through 90° at the product end, preferably a series of angular portions of less than 90° are successively arranged to form the full 90° angle. Output duct 16*a* projects outwardly from the angular portion of upper portion 11*a*, dimensioned so as to be beyond cutoff for the microwave energy propagated through waveguide 10*a*. If desired, flap valve 23 may be provided at the end of duct 16*a* to aid in controlling product flow through the duct. Through the use of an angular portion at the output end of waveguide 10*a*, membrane 15*a* need not be apertured to allow product flow through the outlet duct 16*a* as was provided in the previously described embodiment.

It can be seen that the dimensions of waveguide 10 and input and outlet ducts 16 and 19 can be widely varied according to the microwave energy propagated through the waveguide, and the apparatus is in no way limited to a particular microwave frequency or to particular dimensions.

It has been observed that when using microwave energy at 2450 MHz, the vertical or broad walls of waveguide 10 are preferably from about 2.84 to 4.3 inches (c.a. 7.21 to 10.92 cm) in order to establish the $TE_{10}$ mode. At the 915 MHz range, the vertical or broad wall dimension is preferably 7.85 to 12.0 inches (ca. 19.93 to 30.48 cm). The narrow or top and bottom walls can be varied to adjust electric field intensities but, in order to avoid higher order modes, should be less than ½ the wavelength in free space of the microwave frequency used. The length of the structure can be varied according to the attenuation rate of the particular product to be dried.

In the process of this invention, a syrup or syrup solution is introduced into a co-mingling operation where it (said syrup) is dispersed on the surface of recycled solids. The recycled solids tend to be agglomerated by the syrup but, in proper ratio, agglomerates can be dispersed in small particulate form directly into a dielectrically heated dryer using a cocurrently flowing gas stream (or through an air lock into a vacuum with or without a sweep gas stream) to remove water vapor therefrom. Also, co-mingled syrup and recycle can be dispersed throughout an ebulliating fluid or a fluidized bed of co-mingled recycle and syrup within a dielectrically heated unit. This latter means of operation provides a large, effective ratio of dried solids to syrup being dried in the dielectrically heated fluid bed with little consumed energy penalty, in that the dried carbohydrates have a relatively low response to dielectric heating. Water vapor is removed by a carrier gas. The carrier gas is also used as a cooling means to keep material in the bed below the melting point of solids present. The dried solids are conveyed to a product crushing and classification unit. A desired size range is taken as product, and the remaining reduced in size suitable for recycle.

In a drying operation comprising recycling, it is necessary to choose a dry solid starting feed. This may be material from a previous run or one can use, as simulated recycle, any material compatible with the sugar solution to be dried. In such recycling operation, dry product is displaced from the drying system at a rate depending upon the ratio of recycle solids to solids in the fresh feed (feedstuff to be dried).

At a recycle ratio of twelve parts recycle solids per one part of solids in the syrup fed, the product, after 30 cycles, comprises about 90% fresh feed solids (i.e., solids from the syrup fed). This results when the syrup solution contains 80% solids and 20% water. If four parts recycle solids are used per one part solids in the syrup fed, the product comprises about 90% fresh feed solids after seven cycles through the process.

It was observed that, as water was progressively removed from granular material being dried, the resulting solid product became more and more grainy, as determined by feel when some of the aforesaid granules were pressed in thin section between a spatula and the drying tray. As the dried granules or particles cooled to ambient temperature, and with elapsed time, further solidification took place, with the formation of agglomerated small crystals (as determined by visual observation with the unaided eye).

The particular configuration of the dielectrically heated drying unit useful for conducting the process of the instant invention is selected for energy efficiency and uniform material heating. Dielectric heating and drying for other purposes is, as noted supra, well known.

Dielectric heating apparatus may, as noted supra, employ vacuum (reduced pressure) as a means to easily remove vaporized water with or without the employment of a water vapor removing sweep gas. The use of vacuum to reduce the temperature necessary to obtain water vaporization is well known. Since actual particle temperature is important in optimally accomplishing drying in the process of this invention, the use of vacuum in conjunction with dielectric heating comprising product recycle is a preferred embodiment.

Various means for accomplishing distribution of fresh feed carbohydrate (including sugar) solutions on recycle solids may be employed. For example, the liquid (i.e., sugar solution or sugar syrup) may be reduced to a fine spray and further dispersed in thin film on a tumbling mass of recycle solids, or the two may be co-mingled by a rubbing action as in a shear mixer. It is also possible to convey the liquid in thin section onto the surface of recycled solids using two fluid spray nozzles or a rotating wheel to obtain liquid subdivision for thin film distribution on the surface of the recycled solids.

This invention will be better understood by referring to the following examples, which are specific but non-limiting. It is understood that said invention is not limited by these examples, which are offered merely as illustrations. It is also understood that modifications can be made without departing from the spirit or scope of the invention.

EXAMPLE 1

For process demonstration purposes, a test fructose syrup solution was made by dissolving 80 parts commercially available food grade anhydrous crystalline D-fructose in 20 parts of deionized water. The commercially available D-fructose used had a crystal size approximately 1 millimeter in maximum dimension. For process start-up purposes, a simulated recycle product was made by pulverizing a quantity of the D-fructose crystals to a size range of 50 to 500 microns (0.05 to 0.5 mm).

A Montgomery Ward microwave oven, Model 8077, was used as a dielectric heating device. This heating device or unit was rated as having a 700 watt output power when loaded with 2,000 ml of water. It was experimentally determined that said unit would evaporate one gram of water per minute when an experimental sample (110 g of an admixture of 10 parts by weight of the aforesaid test fructose syrup solution and 100 parts by weight of said simulated recycle product) was co-mingled and spread in granular form in thin section (ca. 3 to 4 mm thick) over a 10-inch diameter Pyrex glass pie plate. A heat setting designated as "reheat" was maintained as a constant.

The process was initiated by distributing 100 grams of said simulated recycle product (particulate anhydrous D-fructose) in thin section (ca. 3 to 4 mm thick) in the Pyrex dish.

An OHAUS beam balance (made by the Newark Scale Co. of Newark, N.J.) reading directly to 0.1 of a gram was used to measure syrup added and product recovered during each drying cycle.

The pie plate containing the 100 grams of said simulated recycle product was placed in the microwave oven and subjected to heating for one minute at the aforesaid "reheat" setting. Less than 0.05 gram weight loss was observed, indicating that the anhydrous crystalline fructose used as a simulated recycle material was essentially non-responsive to dielectric heating and essentially anhydrous. Slight warming of the Pyrex glass plate was noted. After cooling to near room temperature, the dish and its contents were returned to the oven and subjected to a second one-minute of heating. No change in weight was observed. A third one-minute of heating likewise produced no loss in weight.

Having established a reference simulated recycle product weight of 100 grams, syrup addition was initiated by co-mingling 10 grams of syrup (containing 8 grams fructose and 2 grams water) with the simulated recycle product in the dish. Shear mixing was simulated by using a spatula in a back-and-forth rubbing action. The co-mingled material tended to agglomerate, but was readily particulated to approximately $\frac{1}{8}$ inch (ca. 3 mm) diameter particles. These were spread in thin section in the Pyrex dish for the heating cycle. After one-minute heating, it was found that approximately one gram of water was evaporated. After the sample weight was recorded, the material in the Pyrex glass plate was pushed around with the spatula to simulate material movement as would be obtained in a continuous commercial operation. This action also forced new surface contact with ambient gas as would be experienced in a commercial continuous dielectric heating unit. The dish was returned to the oven for a second minute. On removal from the oven, it was found that the remaining material weighed 108 grams. Heating for an additional minute caused no further loss in weight indicating that essentially all water added with the syrup had been evaporated, producing a dry, free-flowing, particulate product.

Eight grams of the thus dried "product" was removed, leaving 100 grams of material for preparing recycle in the second drying cycle. Ten grams of the aforesaid syrup was thoroughly co-mingled with the recycle in the dish and the above-described heating process was repeated again, obtaining a constant weight of 108 grams of substantially anhydrous product in the Pyrex glass dish.

The foregoing procedure was repeated thirty (30) times at the conclusion of which, by calculation, over 90% of the original starting simulated recycle material was removed from the system and replaced by fructose from the aforesaid fructose syrup solution.

The product of this example was placed in a container and subjected to twenty (20) freeze/thaw cycles to note caking performance. There was a slight tendency for the particles which had been subject to this freeze/thaw treatment to adhere one to the other, but a sharp tap on the side of the container was sufficient to render the total mass free-flowing. Each particle maintained its identity, and there was no tendency for the individual particles to fuse together in hard lumps.

EXAMPLE 2

This example demonstrates an important relationship between particle size and water content of sugar/water compositions undergoing dehydration by dielectric heating. The procedure described in Example 1 was followed, with the exception that the recycled material with sugar syrup added thereto was mulled in a mortar to better insure evenly distribution of the syrup as a thin film over the recycled material.

Three series of runs (as set forth below) were made using fructose syrups of three different concentrations (i.e., 80, 70 and 65% fructose, respectively, in water). These solutions were prepared by dissolving commercially available food grade crystalline D-fructose in water. Simulated recycle material for use in starting each series of runs was prepared by grinding the crystalline fructose to a size range of 50 to 500 microns. Dryer feed compositions, as specified in Runs A to H in the following Table, were investigated using the procedure described in Example 1.

TABLE I

| | Grams Recycle | Grams Syrup | % Water in Drier Feed | Recycle Ratio |
|---|---|---|---|---|
| 80% Solids Syrup | | | | |
| Run A | 94 | 6 | 1 | 15.7 |
| B | 90 | 10 | 2 | 11.3 |
| C | 85 | 15 | 3 | 7.1 |
| D | 80 | 20 | 4 | 5.0 |
| 70% Solids Syrup | | | | |
| E | 96.7 | 3.3 | 1 | 41.5 |
| F | 90.0 | 10.0 | 3 | 12.9 |
| G | 86.7 | 13.3 | 4 | 9.3 |
| 65% Solids Syrup | | | | |
| H | 88.4 | 11.6 | 4 | 11.6 |

The dried granular products from these runs (Runs A through H) were checked for caking tendency by repeated freeze/thaw cycling. There was a slight tendency for particles to adhere to one another but, in all instances, a jarring motion produced a free-flowing particulate material.

In other runs using the above-described fructose solutions and an amount of the above-described simulated recycle material such that the water contents of the respective resulting dryer feed compositions were greater than about 4%, it was noted that it was very difficult to obtain effective drying action. It was also noted that particulate dryer feed compositions which contained more than about 4–4.1% water tended to melt and fuse together in liquid globs when heated in the dielectrically heated dryer. When this happened, the water evaporation rate was reduced to almost zero and degradation of the fructose was noted.

EXAMPLE 3

This example demonstrates the utility of the process of the instant invention for converting a commercially available fructose-containing syrup (Isomerose 550 brand high fructose corn syrup) to a dry solid. Said commercially available syrup has the following typical analysis:

| | |
|---|---|
| Solids | 77% |
| Moisture | 23% |
| Ash | 0.03% |
| Carbohydrate Components | |
| Fructose | 55% |
| Dextrose | 41% |
| Other Saccharides | 4% |

Following the procedure of Example 1, a ten cycle run was made, using 50–500 micron crystalline fructose as a starting seed material (i.e., simulated recycle material in the first cycle). Feed to the dryer was fixed at 3% moisture using a recycle ratio of 8.7 parts of recycle per part of dry solids in the syrup feed. After ten cycles, the product was dry, granular and free-flowing, thereby establishing process operability.

EXAMPLE 4

This example further demonstrates the utility of the process of this invention to convert another commercially available fructose-containing syrup (Isomerose 100 brand high fructose corn syrup) to a dry solid. The commercially available syrup has the following typical analysis:

| | |
|---|---|
| Solids | 71% |
| Moisture | 29% |
| Ash | 0.03% |
| Carbohydrate Components | |
| Dextrose | 52% |
| Fructose | 42% |
| Other Saccharides | 6% |

Following the procedure described in Example 1, a ten cycle run was made using 50–500 micron crystalline fructose as a starting seed material (i.e., as simulated recycle in the first cycle of this run). Feed to the dryer was fixed at 3% moisture, using a recycle ratio of 12.5 parts recycle per part of dry solids in the syrup fed. After ten cycles, the product was dry, granular and free-flowing, establishing process operability.

EXAMPLE 5

This example demonstrates process operability for converting another commercially available fructose-containing syrup (Isomerose 900 brand fructose corn syrup) to a dry granular solid. This syrup has the following typical analysis:

| | |
|---|---|
| Solids | 80% |
| Moisture | 20% |
| Ash | 0.03% |
| Carbohydrate Components | |
| Fructose | 90% |
| Dextrose | 7% |
| Other Saccharides | 3% |
| Relative Sweetness* | 120–160 |

*(Sucrose = 100)

Following the procedure of Example 1, a thirty cycle run was made using 50–500 micron crystalline fructose as a starting seed material (i.e., as simulated recycle material in the first cycle. Feed to the dryer was fixed at 3% moisture content, using a recycle ratio of 7.1 parts recycle to one part solids in the syrup fed. After 30 cycles, over 90% of the starting simulated recycle material was removed from the system to establish process operability. The product was a free-flowing, particulate solid. It caked slightly after storage in a closed jar for about six weeks. The cake broke up into granular free-flowing particles when the jar was sharply tapped on its side, indicating a non-hard-caking quality.

EXAMPLE 6

This example, which followed the general procedure of Example 1, demonstrates the operability of the instant process for converting pure sucrose syrups to dry granular solid product.

Pure commercially available sucrose is made from sugar cane or sugar beets. A test syrup (feed syrup) comprising 80 parts of pure sucrose and 20 parts water was prepared. Following the procedure of Example 1, a ten cycle run was made using 50–500 micron crystalline sucrose as a starting seed material (i.e., as simulate recycle in the first cycle of the run). Feed to the dryer was fixed at 1.8% moisture content using a recycle ratio of 12.5 parts recycle to one part solids in the feed syrup. Ten cycles were run and a dry, free-flowing particulate product (sucrose) was produced, thereby establishing process operability.

EXAMPLE 7

This example, which followed the general procedure of Example 1, demonstrates process operability with a sucrose syrup comprising molasses. A sugar solution of this kind is representative of the complex mixture of total sugars obtained in a cane or beet refinery operation. The test syrup was made by mixing 80 parts of the pure sucrose solution used in Example 6 with 20 parts of commercially available food grade cane molasses (approximately 80% solids). A ten cycle run was made using 50–500 micron crystalline sucrose as a starting seed material. Feed to the dryer was fixed at 1.8% moisture content using a recycle ratio of 12.5 parts recycle to one part solids in the syrup feed. Ten cycles were completed and a dry, free-flowing particulate product was produced. This established process operability:

EXAMPLE 8

(Continuous Operation Using Dielectrically Heated Fluid Bed Drying)

Figure 8:
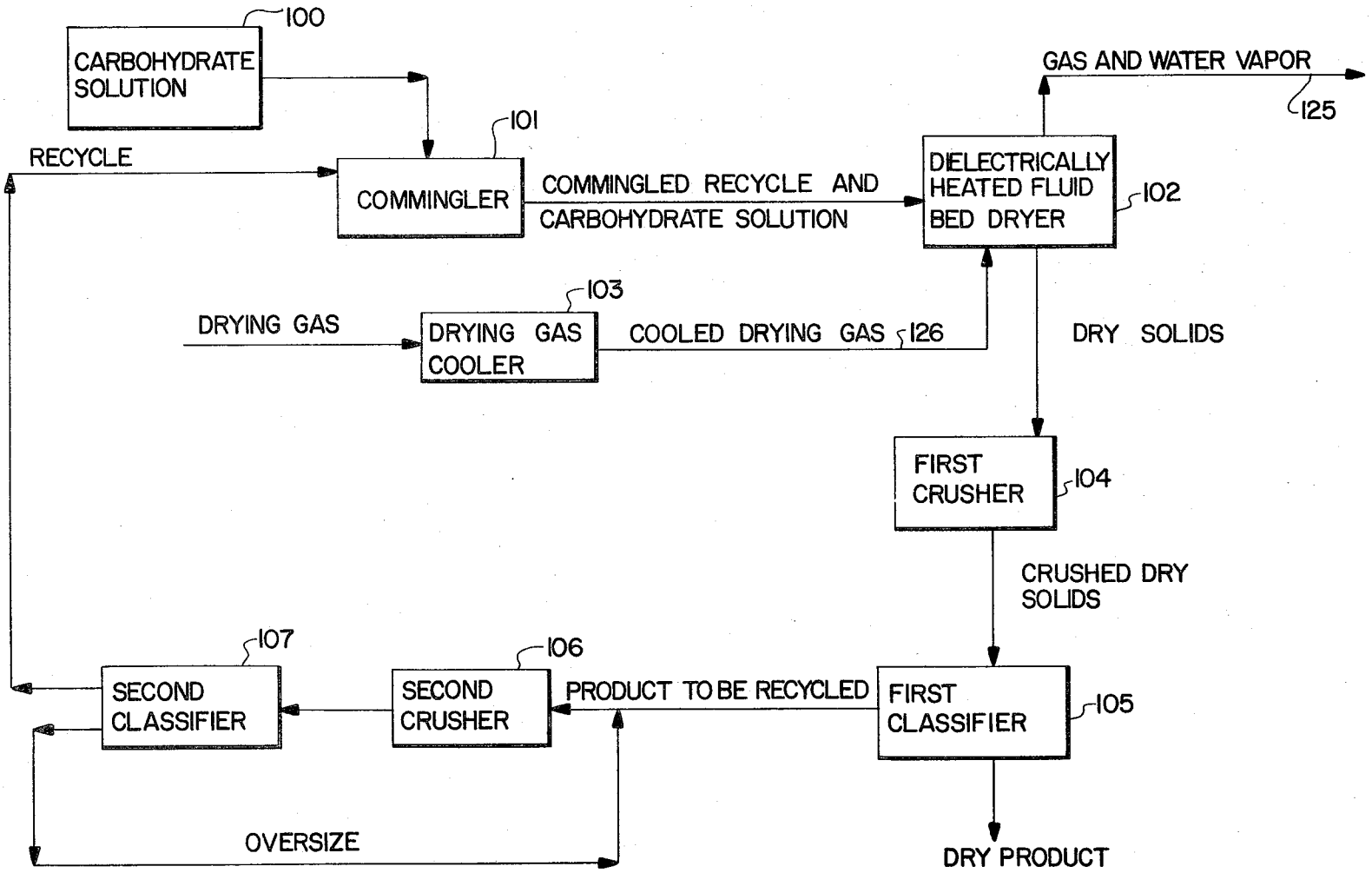
FIG. 8 is a flow-sheet of an embodiment of this invention wherein the drying step of said invention is conducted in a dielectrically heated fluidized bed dryer.

A dry, free-flowing, stable, non-caking particulate product can be prepared from a complex carbohydrate solution or other carbohydrate solution in a continuous manner by using the following procedure:

Referring to FIG. 8, an aqueous carbohydrate solution from storage tank 100 and recycled product from a later recited drying and sizing operation (or a simulated recycled product when starting a run) are co-mingled in a predetermined ratio in co-mingler 101 to form a moist solid admixture of particulates approximately less than 3 mm major dimension, which is passed (e.g., by conveyor belt, screw conveyor or the like) in a continuous manner to dielectrically heated fluid bed dryer 102 (which contains a fluidized bed of nearly dry particulate recycled carbohydrate material or simulated recycled material at start-up) where it is contacted with cooled drying air or other inert gas from gas cooler 103 having a flow rate and temperature effective for maintaining the temperature of the fluidized bed below the melting point of the material comprising said bed, said rate also being effective for maintaining said bed in a fluidized state and for removing vaporized water from said fluidized bed dryer 102. If desired, the gas cooling step can be omitted in which instance drying gas at about atmospheric temperature is used. In winter, it may be desirable to warm the gas using a gas heater (not shown). Dried product exits fluidized bed dryer 102, passes to a sizing operation comprising first crusher 104, first classifier 105, second crusher 106 and second classifier 107. Dried product from fluidized bed dryer 102 is crushed in first crusher 104, and the crushed dry product is passed to first classifier 105. A predetermined portion of classified dry product from first classifier 105 having a predetermined particle size is collected as product. The remainder of the dry classified product from first classifier 105 is passed to second crusher 106 where it is further crushed and passed to second classifier 107. A predetermined portion of dried classified product from second classifier 107 having a predetermined particle size range (e.g., preferably between about 50 and about 500 microns) is recycled to co-mingler 101 while oversize particles from second classifier 107 are recycled to second crusher 106. If desired, a portion of the oversize particles from second classifier 107 can be collected as product. Also, if desired, any very fine particles (e.g., particles finer than about 50 microns ) from second classifier 107 can be collected as product or recycled to co-mingler 101. If desired, fluid bed dryer 102 can be operated under reduced pressure by attaching gas outlet line 125 to a source of reduced pressure, such as a vacuum pump (not shown) and by reducing the rate of flow of drying gas into fluid bed 102 by a means, such as a valve (not shown) in gas inlet line 126.

EXAMPLE 9

(Continuous Operation Using Dielectrically Heated Cocurrent Drying)

Figure 9:
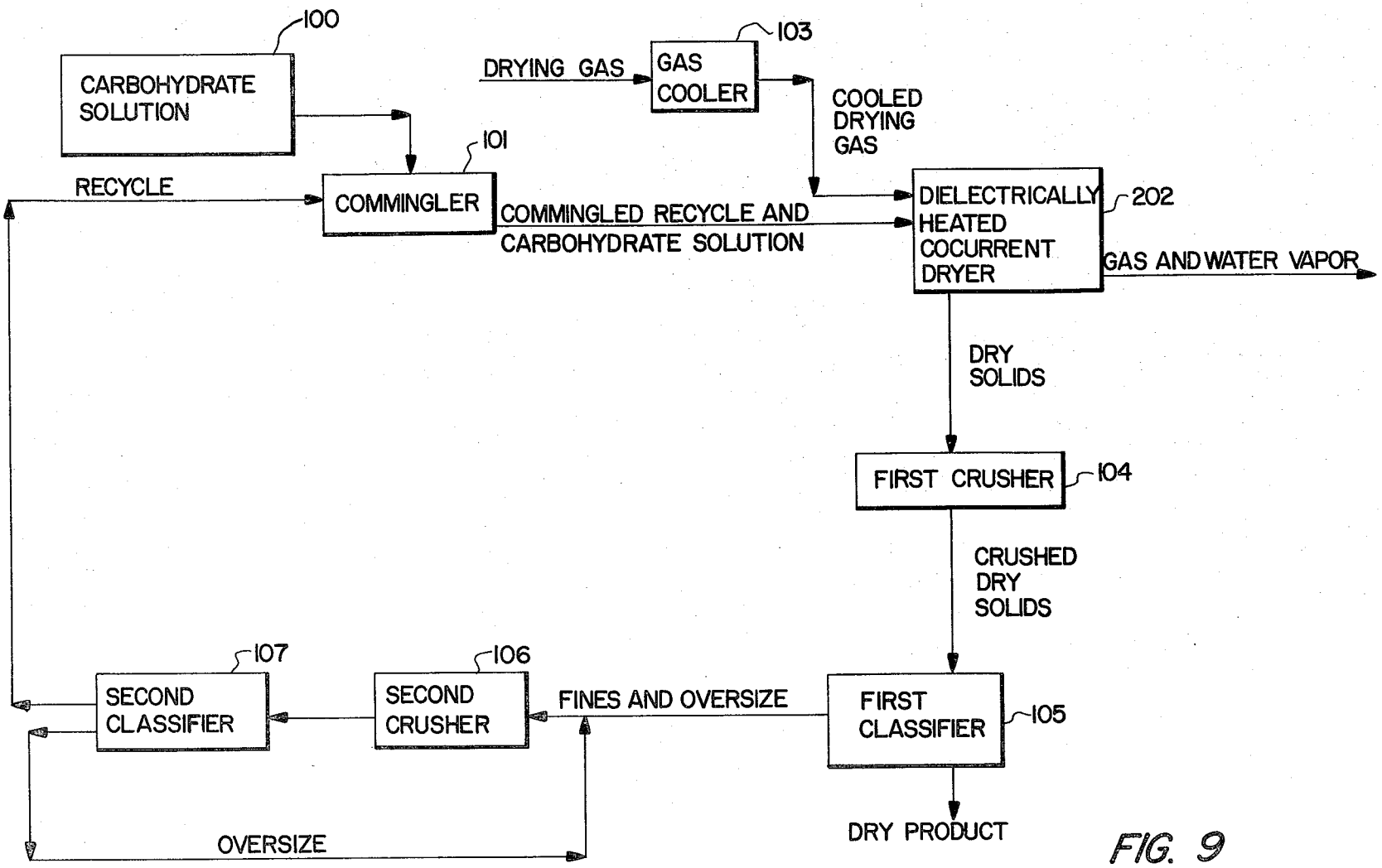
FIG. 9 is a flow-sheet of an embodiment of this invention wherein the drying step of said invention is conducted in a dielectrically heated dryer using a cocurrent stream of drying gas to remove water vapor from the dryer. In this embodiment, it is preferred that the material passing through the dielectrically heated dryer be carried on a belt conveyor. However, other means of conveyance, such as travelling trays, screw conveyors or the like may be used.

A dry, free-flowing, stable, non-caking particulate product can be prepared from a complex carbohydrate solution or other carbohydrate solution in a continuous manner by using the following procedure:

Referring to FIG. 9, the procedure in this instance is that recited in Example 8, supra, except that the dielectrically heated fluid bed dryer of Example 8 is replaced with dielectrically heated cocurrent dryer 202. When using the dielectrically heated dryer of this example, cooled drying gas (air or other inert gas) from gas cooler 103 and the moist solid granular admixture of recycled product and the carbohydrate solution from co-mingler 101 enter the dryer in cocurrent flow (rather than in countercurrent flow).

Information relating to a continuous run where using the embodiment of this example (Example 9) is shown in flowsheet form in FIG. 9.

EXAMPLE 10

(Continuous Operation Using Dielectrically Heated Vacuum Drying)

Figure 10:
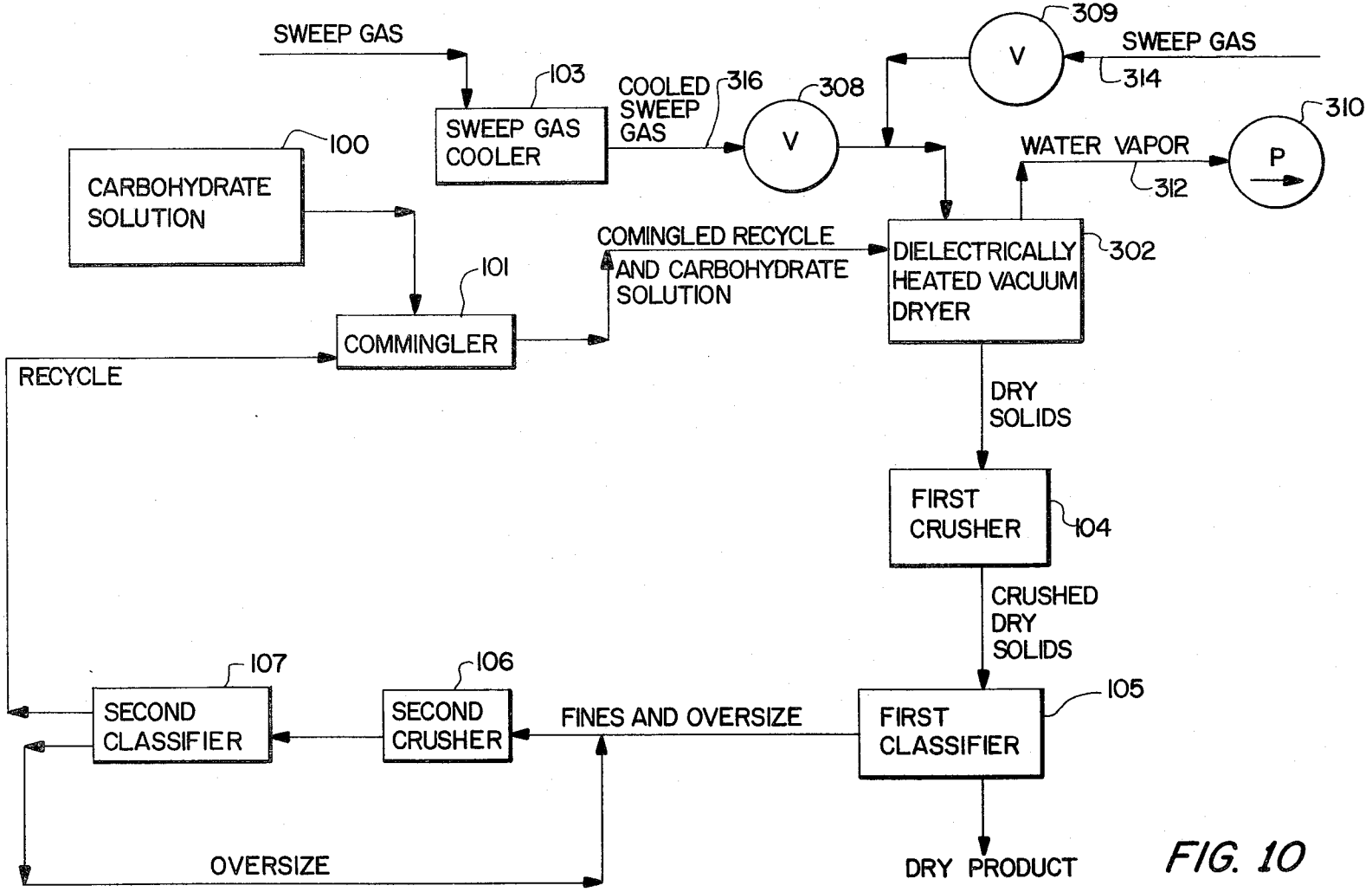
FIG. 10 is a flow-sheet of an embodiment of this invention wherein the drying step of said invention is conducted in a dielectrically heated dryer using vacuum (reduced pressure), with or without a stream of sweep gas, to remove water vapor from the dryer. In this embodiment, it is preferred that the material passing through the dielectrically heated dryer be carried on a belt conveyor and that the product be cooled before discharge through an air lock.

A free-flowing, stable, non-caking particulate product can be prepared from a complex carbohydrate solution or other carbohydrate solution, such as an aqueous solution of (a) fructose, (b) sucrose, or (c) dextrose, in a continuous manner by using the following procedure:

Referring to FIG. 10, the procedure in this instance is that recited in Example 8, supra, except that the dielectrically heated fluid bed dryer of Example 8 is replaced with dielectrically heated vacuum dryer 302, which can be operated with or without a sweep gas. It is preferred that the material be belt-conveyed through the dielectrically heated vacuum dryer.

Vacuum source 310 (e.g., a vacuum pump or the like) communicates with dielectrically heated vacuum dryer 302 via vacuum line 312. If desired, a stream of sweep gas may be provided via line 314 and valve 309. Alternatively, cooled sweep gas may be provided via sweep gas cooler 103, cooled sweep gas line 316 and valve 308.

If, during the winter, it becomes desirable to warm the drying gas used in Examples 8 and 9 and sweep gas used in Example 10, this can be done with a gas heater (not shown in the drawings).

When using the microwave fluidized bed dryer of FIGS. 1–7 as the dielectrically heated fluid bed dryer in the process of this invention as described herein (including the description in Example 8, supra), the admixture prepared by co-mingling recycle (or simulated recyle) and syrup is fed into microwave fluidized bed heater via inlet port or duct 19 or 19*a*, and dried granular product exits from said dryer via outlet port or duct 16 or 16*a*. Drying gas which can be cooled or heated enters said dryer via gas inlet ports or ducts 17 or 17*a* and exits (as a stream of gas and water vapor) from said dryer via gas outlet ports or ducts 18 or 18*a*.

Solid particulate materials used or produced in the process of this invention can be conveyed by conveyor belts, screw conveyors, conveyor buckets, continuous flow conveyors, cahin conveyors and the like.

Co-minglers (mixers) which are operable in the process of this invention (see, for example, the procedure described in Examples 8–10) include, but are not limited to, blade mixers, mullers, rotor mixers, screw conveyor mixers, kneader mixers and ribbon mixers.

Crushers which are operable in the process of this invention (see, for example, the procedures described in Examples 8–10 ) include, but are not limited to, jaw crushers, gyratory crushers, cone crushers, pan crushers, roll crushers, rotary crushers, impact crushers, ball or pebble mill crushers and disc attrition mills.

Classifiers which are operable in the process of this invention (see, for example, the procedures set forth in Examples 8–10 ) include, but are not limited to, screens, including vibratory screens, sieves and air classifiers.

Carbohydrate solutions operable in the process of this invention include aqueous sugar solutions prepared by multistage vacuum evaporation to economically and operationally minimum water content. However, dissolved carbohydrate concentration is not critical because very dilute (e.g., 1–10% carbohydrate content) solutions are operable but, for economic reasons, are not preferred. Also, slurries or dispersions comprising solid particles of a carbohydrate in an aqueous solution saturated with said carbohydrates are operable.

Since recycle ratio is based on the carbohydrate content of the carbohydrate solution to be dried, it becomes generally economically impractical (although technically operable) to dry solutions containing less than about 65% by weight of said dissolved carbohydrate.

The process of this invention is operable for preparing a stable, solid, substantially anhydrous particulate product from aqueous solutions comprising total sugars from sugar cane and from sugar beets.

As used herein, the term "carbohydrate solution", unless otherwise defined where used, means an aqueous sugar solution including a complex sugar solution and a simple sugar solution. A "complex sugar solution" is an aqueous sugar solution containing more than one sugar (including more than one isomer) A "simple sugar solution" is an aqueous sugar solution (a) consisting essentially of one sugar, or (b) consisting of one sugar as solute. Thus, an aqueous solution containing fructose and dextrose is a complex sugar solution. A "complex carbohydrate solution" is an aqueous solution containing at least two carbohydrates (e.g., two or more sugars or one or more sugar plus a carbohydrate such as dextrin). The process of this invention is operable with such complex carbohydrate solution.

The term "total sugars" as used herein, unless otherwise defined where used, means all the sugars extracted from sugar can or sugar beets in a sugar refining operation.

As used herein, the term "percent (%)", unless otherwise defined where used, means parts per hundred by weight.

The stable, solid, substantially anhydrous particulate product prepared by the process of this invention is useful as food for humans and as feed for animals. Various other uses will be readily apparent to those skilled in the art.

While this invention has been described, supra, in terms of certain preferred embodiments, it is not intended to limit the invention to the particular forms set forth. On the contrary, it is intended to cover and include all alternatives, modifications and equivalents which are within the spirit and scope of the invention as defined by the appended claims.

What is claimed:

1. A process for drying a carbohydrate solution to form a stable, solid, substantially anhydrous particulate product therefrom comprising:

(a) co-mingling said carbohydrate solution with recycled dry product solid to form a particulate admixture dryable in a dielectrically heated drying zone;

(b) drying said particulate admixture in said dielectrically heated drying zone at a particle temperature below the melting point of said particulate admixture to form said stable, solid, substantially anhydrous product;

(c) removing said stable, solid, substantially anhydrous product from the drying zone and dividing it into a first portion and a second portion;

(d) recycling said first portion; and (e) recovering said second portion.

2. The process of claim 1 in which the carbohydrate is fructose.

3. A process for drying a carbohydrate solution to form a stable, solid, substantially anhydrous particulate product therefrom comprising:

(a) co-mingling said carbohydrate solution with about 5 to 20 parts of recycled dry product solids per part of solids in said solution in a co-mingling zone to form a particulate admixture dryable in a dielectrically heated drying zone and having a water content of not more than about 4% by weight;

(b) drying said particulate admixture at a particle temperature below the melting point of said particulate admixture, in a gas stream in said dielectrically heated drying zone to form said stable, solid, substantially anhydrous product;

(c) discharging said stable, solid, substantially anhydrous product from the drying zone and dividing it into a first portion and a second portion;

(d) recycling said first portion to the co-mingling zone; and (e) recovering said second portion.

4. The process of claim 3 in which the carbohydrate is fructose.

5. The process of claim 3 in which the gas stream has a temperature and a flow rate effective for maintaining the temperature of solid particles within the dielectrically heated drying zone below their melting point.

6. The process of claim 3 in which the particle size of the particles of said first portion is adjusted to about 50–500 microns before they are recycled to the co-mingling zone.

7. The process of claim 3 in which the dielectrically heated zone for drying the particulate admixture comprises an elongated enclosed waveguide having a low loss gas-porous membrane dividing said waveguide into two portions, means for directing a fluidizing gas into the bottom portion of said waveguide through said membrane, so as to establish a fluidized bed with said particulate admixture and a dielectric energy source adapted to propagate dielectric energy through said waveguide.

8. The process of claim 3 in which the dielectrically heated drying zone is a fluidized bed operating under reduced pressure.

9. The process of claim 3 in which the co-mingled carbohydrate solution and recycled product solids is belt-conveyed under vacuum through (i) the dielectrically heated drying zone, and (ii) a cooling zone before discharging.

10. The process of any one of claims 3, 5, 6, 7 or 8 in which the carbohydrate solution comprises water and at least one member selected from the group consisting of fructose, dextrose, sucrose, total sugars from sugar cane, total sugars from sugar beets, sugar cane molasses and sugar beet molasses.

11. A process for drying a carbohydrate solution to form a stable, solid, substantially anhydrous particulate product therefrom comprising:

(a) co-mingling, in a co-mingling zone, said carbohydrate solution with an amount of recycled dry product solids effective for forming a particulate admixture dryable in a dielectrically heated drying zone and having a water content of not more than about 4% by weight;

(b) drying said particulate admixture in a gas stream in said dielectrically heated drying zone to form said stable, solid, substantially anhydrous product;

(c) discharging said stable, solid, substantially anhydrous product from the drying zone and dividing it into a first portion and a second portion;

(d) recycling said first portion to the co-mingling zone; and (e) recovering said second portion.

12. The process of claim 11 in which the carbohydrate is fructose.

13. The process of any one of claims 1, 3 or 11 in which the stable, solid, substantially anhydrous particulate product is free-flowing.

* * * * *

UNITED STATES PATENT AND TRADEMARK OFFICE

CERTIFICATE OF CORRECTION

PATENT NO. : 4,294,624

DATED : October 13, 1981

INVENTOR(S) : PRESTON L. VELTMAN

It is certified that error appears in the above-identified patent and that said Letters Patent are hereby corrected as shown below:

In claim 11 (col. 18, line 3) insert following the word "admixture" --at a temperature below its fusion point--.

Signed and Sealed this

*Fourteenth* Day of *September 1982*

[SEAL]

*Attest:*

GERALD J. MOSSINGHOFF

*Attesting Officer*

*Commissioner of Patents and Trademarks*